United States Patent [19]

Bahn et al.

[11] 4,398,127

[45] Aug. 9, 1983

[54] ELECTRIC FLASH LAMP UNIT WITH A LIGHT CONTROLLING CIRCUIT

[75] Inventors: Itsuki Bahn, Higashioizumi; Tadao Miyata, Tokyo, both of Japan

[73] Assignee: Secoh Giken, Inc., Tokyo, Japan

[21] Appl. No.: 235,631

[22] Filed: Feb. 18, 1981

[30] Foreign Application Priority Data

Feb. 18, 1980 [JP] Japan ..... 55-17854

[51] Int. Cl.[3] ..... H05B 41/32

[52] U.S. Cl. ..... 315/151; 315/241 P; 354/23 D; 354/33; 354/127; 354/145

[58] Field of Search ..... 315/129, 135, 136, 151, 315/159, 241 P, 340; 354/23 D, 27, 32–34, 60 F, 127, 128, 145

[56] References Cited

U.S. PATENT DOCUMENTS 4,258,991 3/1981 Kuraishi ..... 354/32

4,262,997 4/1981 Yuasa ..... 354/23 D

*Primary Examiner*—Eugene R. La Roche

*Attorney, Agent, or Firm*—Oblon, Fisher, Spivak, McClelland & Maier

[57] ABSTRACT

An electric flash lamp unit is provided with an electric flash lamp and a storage capacitor for supplying energy to the flash lamp unit. An optimum exposure value of a film is previously determined. Therefore, a flash time of the flash lamp for providing the optimum exposure is determined by providing a distance from a flash lamp to an object to be photographed, a film sensitivity, an F number, and a charge voltage of the storage capacitor. A number of flash time data with the associated addresses are stored in a ROM. The distance information modified by the film sensitivity and the F number and the charge voltage information of the storage capacitor are used as address data for the ROM. The flash time data is read out from the ROM by the address data and is used to deenergize the electric flash lamp.

27 Claims, 14 Drawing Figures tp
to
td
166
168
170
tp

ELECTRIC FLASH LAMP UNIT WITH A LIGHT CONTROLLING CIRCUIT

BACKGROUND OF THE INVENTION

The present invention relates to an electric flash lamp unit with a light controlling circuit which can control an amount of flash light in accordance with a distance from a flash lamp to an object to be illuminated with the flash lamp.

There have been many proposals of the electric flash lamp units of this type. One of the flash lamp units proposed has a light control circuit in which light reflected from the object is photoelectric converted, the photoelectric converted signal is integrated by an integrating circuit including a capacitor, the flash is terminated when the integrated value reaches a given value. The light controlling circuit of the conventional flash lamp unit has a function like that of a memory for accumulatively storing the reflected light. Therefore, the light control circuit integrates not only the reflected light from the object but also the light from other flash light units, so that the flash lamp unit terminates the flash before an optimum exposure value is obtained. Japanese Patent Publication No. 28006/77 discloses a light control circuit without the integrating circuit to solve the above-mentioned problem. The light control circuit without the integrating circuit still involves a problem in a means to control the amount of light emitted from the flash lamp in accordance with a distance from the flash lamp to the object.

SUMMARY OF THE INVENTION

Accordingly, an object of the present invention is to provide a flash terminating signal generating circuit constructed by a digital technology.

Another object of the present invention is to provide an electric flash lamp unit adaptable for various photographings.

According to one aspect of the present invention, there is provided a flash terminating signal generating circuit comprising:

means for generating clock pulses;

means for counting the clock pulses in response to a flash starting signal;

memory means for storing a plurality of time data corresponding to a flash time of an electronic flash lamp in a plurality of memory locations with corresponding addresses;

means for converting distance information into a first address data, supplying the first address data to said memory means, thus designating one of the addresses of said memory means, and reading a given time data from the memory location thus designated; and comparing means for comparing the time data with the contents of said counting means and producing a flash terminating signal when both the time data and the contents are coincident with each other.

According to another aspect to the present invention, there is provided a flash terminating signal generating circuit comprising:

means for generating clock pulses;

means for counting the clock pulses in response to a flash starting signal;

memory means for storing a plurality of time data corresponding to a flash time of an electric flash lamp in a plurality of memory locations with corresponding addresses;

means for measuring information of a distance from a flashing point to an object illuminated by flash light;

means for converting the distance information supplied from said measuring means into first address data, supplying the first address data to said memory means, thus designating one of the addresses of said memory means, and reading a given time data from the memory location thus designated; and means for comparing the time data with the contents of said counting means and producing a flash terminating signal when both the time data and the contents are coincident with each other.

According to still another aspect of the present invention, there is provided an electric flash lamp unit for energizing an electric flash lamp by supplying the lamp with energy stored in a capacitor:

means for detecting a voltage charged in said capacitor;

means for modifying the signal supplied from said means with a film sensitivity and an F number; and means for comparing the charge voltage signal with a reference signal containing distance information and producing an alarm signal.

According to yet another aspect of the present invention, there is provided an electric flash lamp unit for energizing an electric flash lamp by supplying the lamp with energy stored in a capacitor:

means for detecting a voltage charged in said capacitor;

means for modifying the signal supplied from said means by a film sensitivity and an F number; and means for decoding the output signal from said modifying means and displaying the decoded distance information.

Other objects and features of the present invention will be understood from the following description taken in connection with the accompanying drawings, in which:

DETAILED DESCRIPTION OF THE PREFERRED EMBODIMENTS

Figure 1:
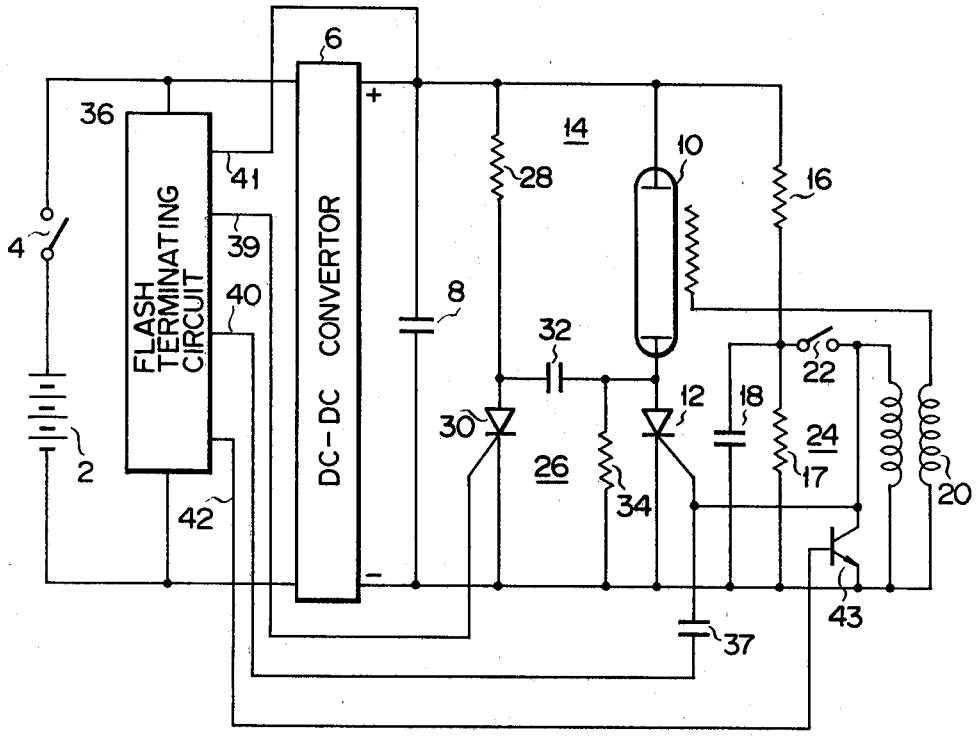
FIG. 1 is a circuit diagram of an electric flash lamp unit which is an embodiment of the present invention.

FIG. 1 is a circuit diagram of an electric flash lamp unit according to the present invention. In the electric flash lamp circuit, a DC-DC converter 6 is connected through a power switch 4 to a DC voltage source 2. The DC-DC converter 6 is connected to a storage capacitor 8 and the storage capacitor 8 is connected in parallel to a series circuit including electric flash lamp 10 and an SCR 12, whereby those components form a discharge circuit 14. The DC—DC converter 6 is further connected through a resistor 16 to an ignition capacitor 18 which is connected across a resistor 17 and across the primary winding of an ignition transformer 20 through a synchronous contact switch 22. The secondary winding of the ignition transformer 20 is connected to a triggering electrode of the electric flash lamp 10. The gate of the SCR 12 is connected through the synchronous contact switch 22 to the capacitor 18. The primary and secondary windings of the ignition transformer 20, the switch 22, the capacitor 18, resistor 17 and the SCR 12 form a triggering circuit 24 for triggering the electric flash lamp 10. The electric flash lamp unit is provided with a commutation circuit 26 which renders the SCR 12 non-conductive to deenergize the flash lamp 10. In the commutation circuit 26, the DC—DC converter 6 is connected across a series arrangement of a resistor 28 and an SCR 30. A commutation capacitor 32 is connected between the anodes of the SCR 30 and SCR 12. A resistor 34 is connected in parallel with the SCR 30, via the capacitor 32.

The fundamental arrangement and circuit operation of the electric flash lamp circuit are well known in this field. For better understanding of the present invention, the circuit operation will be described in brief. In the electric flash lamp circuit, when the synchronous contact switch 22 of the triggering circuit 24 is closed, the ignition capacitor 18 is discharged, so that a trigger pulse is induced in the secondary winding of the ignition transformer 20. In response to the trigger pulse, the flash lamp 10 is energized, the SCR 12 is rendered conductive, and electrical energy is supplied from the storage capacitor 8 to the electric flash lamp 10 which in turn flashes. When the flash lamp 10 is deenergized, a flash terminating signal is applied to the gate of the SCR 30 of the commutation circuit 26 to discharge the commutation capacitor 32. As a result of the discharge of the capacitor 32, the cathode potential of the SCR 12 rises to render the SCR 12 non-conductive and to terminate the discharge of the flash lamp 10.

According to the present invention, the electric flash lamp circuit is further provided with a new flash terminating circuit 36. The flash terminating circuit 36 is connected to a DC power source through a constant voltage circuit (not shown). An output terminal 39 for providing the flash terminating signal of the flash terminating circuit 36 is connected to the gate of the SCR 30. A synchronous signal input terminal 40 is connected to the ignition capacitor 18, through a capacitor 37 and the synchronous contact switch 22. The input terminal 40 may be connected to the flash lamp 10 so as to detect discharge current of the flash discharge lamp 10. The electric flash lamp circuit further includes a switching element such as a transistor 43 for disabling the triggering circuit 24. The collector-emitter path of the transistor 43 is connected across the primary winding of the ignition transformer 20. The base of the transistor 43 is connected to an additional output terminal 42. The flash terminating circuit 36 is further provided with a voltage detecting terminal 41 for detecting a charge voltage V across the storage capacitor 8.

Figure 2:
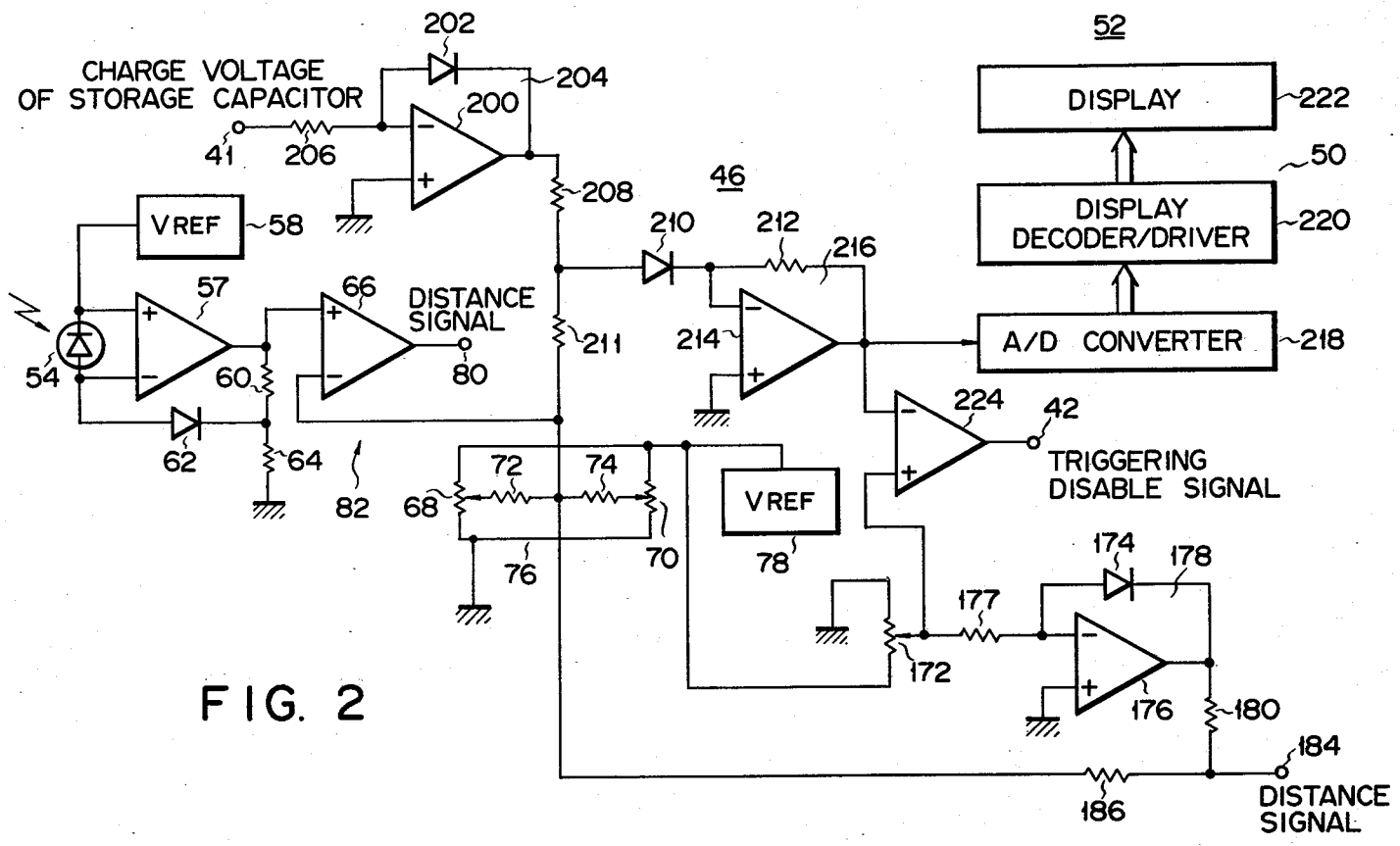
FIG. 2 is a circuit diagram of an analog section of a flash terminating signal generating circuit used in the circuit of FIG. 1.

Before describing the flash terminating circuit 36 illustrated in FIGS. 2 and 3 which produces a flash terminating signal when an optimum exposure for a film is set up, a principle of the flash terminating circuit will be described.

Figure 4:
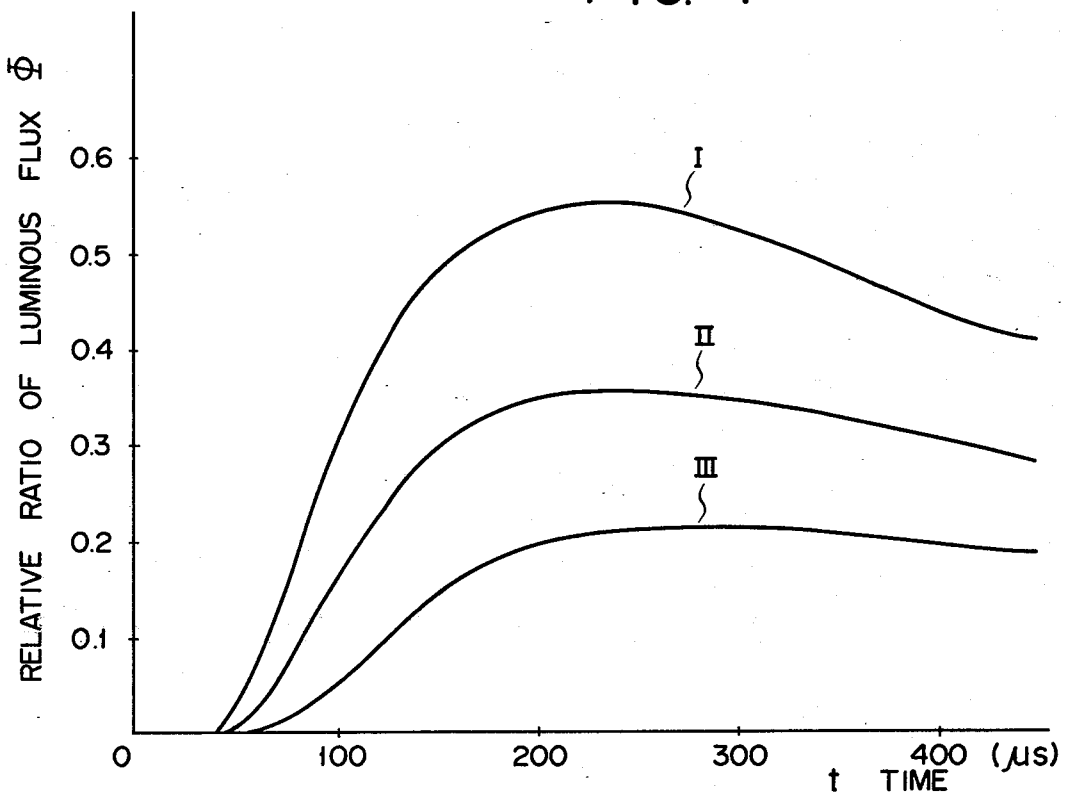
FIG. 4 is a graphical representation of a luminous characteristic of an electric flash lamp.

FIG. 4 graphically illustrates luminous flux curves I, II and III with respect to time t, with a graph having a luminous flux $\phi$ on the ordinate and time on the abscissa. When a characteristic of the flash lamp 10, a reflectivity of a reflective mirror in the flash lamp unit and the like are determined, the luminous flux $\phi$ solely depends on a charge voltage V across the capacitor 8 immediately before the capacitor 8 is discharged, and time t. In the graph of FIG. 4, I, II and III indicate luminous flux curves when the charge voltages V are 350 V, 300 V and 250 V, respectively. The luminous $\phi$ accordingly is expressed by $$\phi = f(V,t) \tag{1}$$

Illumination at an object to be photographed to which the luminous flux $\phi$ is directed is also given by $$\begin{aligned} L &= C \times \phi / r^2 \\ &= C \times f(V, t) \times 1/r^2 \end{aligned} \tag{2}$$

where C is a constant coefficient dependent on an average reflectivity of the object, and r is a distance between the electric flash lamp and the object. The equation (2) indicates that, when the charge voltage V across the capacitor 8 is set to a fixed value $V_I$, the illumination L is a function of time t and the distance r. Therefore, if time to be taken for the illumination L to reach a fixed value Lo is known, the equation (2) provides the distance r. Conversely, if the distance r is known, it provides time $t_o$. In this respect, the equation (2) can also be expressed;

$$Lo = C \times f(V_I, t_o) \times 1/r^2 \tag{3}$$

Figure 5:
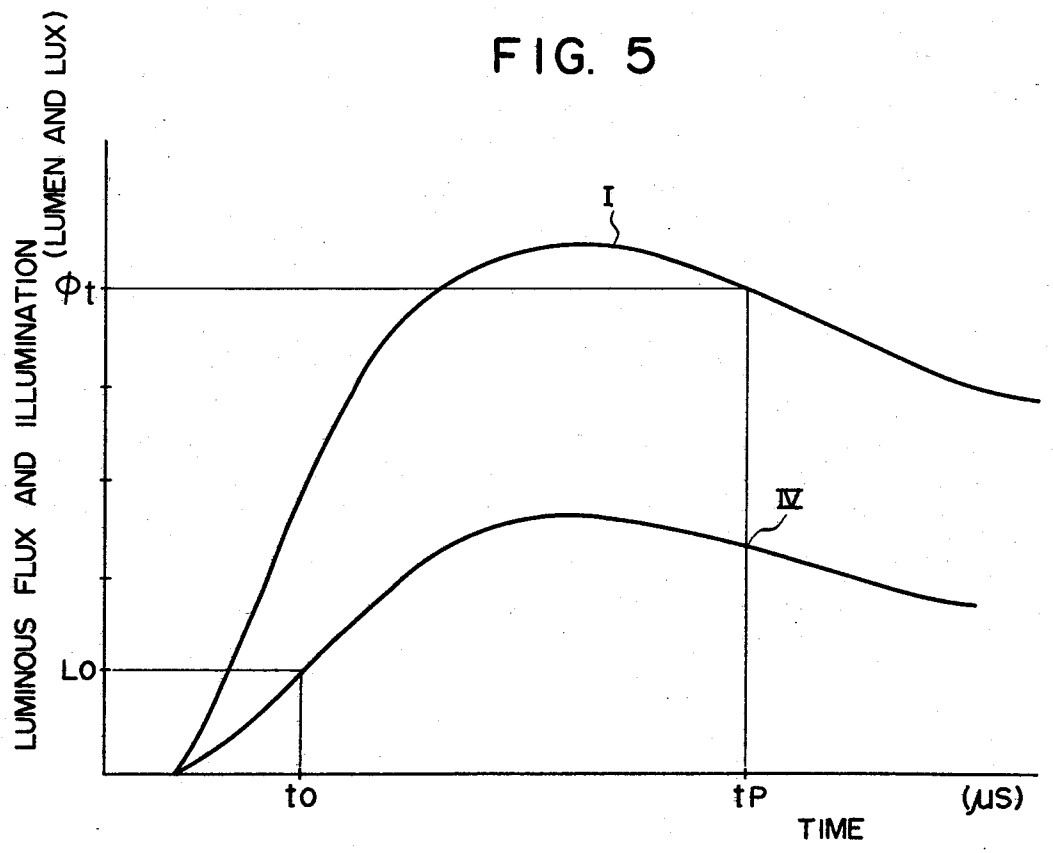
FIG. 5 is a graphical representation of a relationship between a luminous flux projected from an electric flash lamp and an illumination of an object separated by a given distance from the flash lamp.

For 350 V of the fixed charge voltage $V_I$, for example, the illumination of the object is plotted as a curve IV in FIG. 5 with relation to the luminous flux curve I of the electric flash lamp energized at that voltage $V_I$. Thus, a relationship between Lo and the time $t_o$ is defined by the curve IV. Hence, the distance r can be obtained by the equation (3) when $t_o$ to provide the given illumination Lo is measured.

An exposure value E for a film in a camera is related to the illumination L of the object by the following relation;

$$E = Ko \times S/F^2 \int L dt \tag{4}$$

As seen from the equation (4), the exposure value E is proportional to the film sensitivity S and an integrated value of the illumination L of the object with respect to time t, but is inversely proportional to a square of an F number of a camera lens. In the equation (4), Ko is a proportionality constant. Substituting the equation (2) which expresses the illumination L into the equation (4), we have $$E = CKo/r^2 \times S/F^2 \int f(V,t)dt \quad (5)$$

An optimum value Ep of the exposure value E is previously selected, the F number is properly selected, and C and Ko are constants. So, let $CKo \times S/F^2$ be Ao. By using Ao, the equation (5) can be rewritten into $$Ep = Ao/r^2 \int_0^{t_p} f(V, t)dt \quad (6)$$

From the equation (6), it is seen that, if the charge voltage V is set to have a given value, the distance r has a correlation with the optimum exposure time $t_p$.

The equation (6) may also be expressed by the following logarithmic equation.

$$\log Ep = (\log Ao - 2 \log r) + \log \left[ \int_0^{t_p} f(V, t)dt \right] \quad (7)$$

The equation (7) indicates that, when many time data of $t_p$ are stored in a ROM 44 with addresses associated therewith of the charge voltage V and the distance r which is properly modified by the constant Ep and the constant Ao including the factors of the film sensitivity S and the F number, the optimum time $t_p$ can be obtained from the ROM 44. In other words, the optimum time $t_p$ may be read out by the address data which is converted from the modified distance information and the voltage information.

A relationship between the time $t_o$ taken for the illumination of the object to reach the give value Lo and the distance r is given by the equation (3), as mentioned above, and may also be expressed by the following logarithmic equation.

$$\log Lo = \log C + \log f(V,t_o) - 2 \log r \quad (8)$$

Eliminating log r in the equation (7) and letting the charge voltage V in the equation (7) be $V_I$, we have an equation (9)

$$\log Ep = \log Ao + (\log Lo - \log C) - \log f(V_I, t_o) + \log \left[ \int_0^{t_p} f(V_I, t)dt \right] \quad (9)$$

In the equation (9), since (log Lo−log C) and log Ep are constant, if log Ao and the charge voltage $V_I$ are set to have known values, the optimum exposure time $t_p$ may be obtained from the ROM 44 by using the measured time $t_o$. That is, the measured time $t_o$ means distance information. Therefore, if the measured time $t_o$ is previously modified by the constants and it as well as the voltage $V_I$ may be converted into the address data, the optimum exposure time $t_p$ may be read out from the ROM 44 by the address data.

The flash lamp terminating circuit 36 constructed on the basis of the principle as mentioned above will be described referring to FIGS. 2 and 3. The circuit 36 is comprised of an analog section generally designated by reference numeral 46 and a digital section generally designated by reference numeral 52 containing a distance display circuit 50 shown in FIG. 2 and a circuit shown in FIG. 3. The analog section 46 shown in FIG. 2 is provided with a photo detector 54, such as a photo diode, for detecting the illumination L at the object. The photo diode 54 is connected between the inverting and non-inverting inputs of a logarithmic amplifier 56. The non-inverting input of the logarithmic amplifier 56 using an operational amplifier 57 is also connected to a reference voltage source 58. In the logarithmic amplifier 56, a resistor 60 and a diode 62 are connected in series between the inverting input and the output of the operational amplifier 57. The cathode of the diode 62 is grounded through a resistor 64. The logarithmic amplifier 56 produces an illumination signal representing a logarithmic value of the illumination L of the object. The output of the logarithmic amplifier 56 is connected to the non-inverting input of an operational amplifier 66 serving as a comparator. The inverting input of the comparator 66 is connected to a reference voltage source 78, through a resistor arrangement 76 containing variable resistors 68 and 70 and resistors 72 and 74 for setting resistances representing logarithmic values, log S of the film sensitivity S and log F of the F number. With such a connection, the illumination signal of log L is applied to the non-inverting input of the comparator 66. The reference signal modulated by the film sensitivity of log S and F number of log F is applied to the inverting input of the comparator 66. Therefore, when the illumination signal reaches a given level Lo, the output 80 of the comparator 66 provides distance signal containing modified distance information as already referred to by using the equation (3). The photo diode 54, the logarithmic amplifier 56 and the comparator 66 cooperatively form a distance signal generating circuit 82.

Figures 6A, 6B, 6C, 6D, 6E, 6F, 6G, 6H:
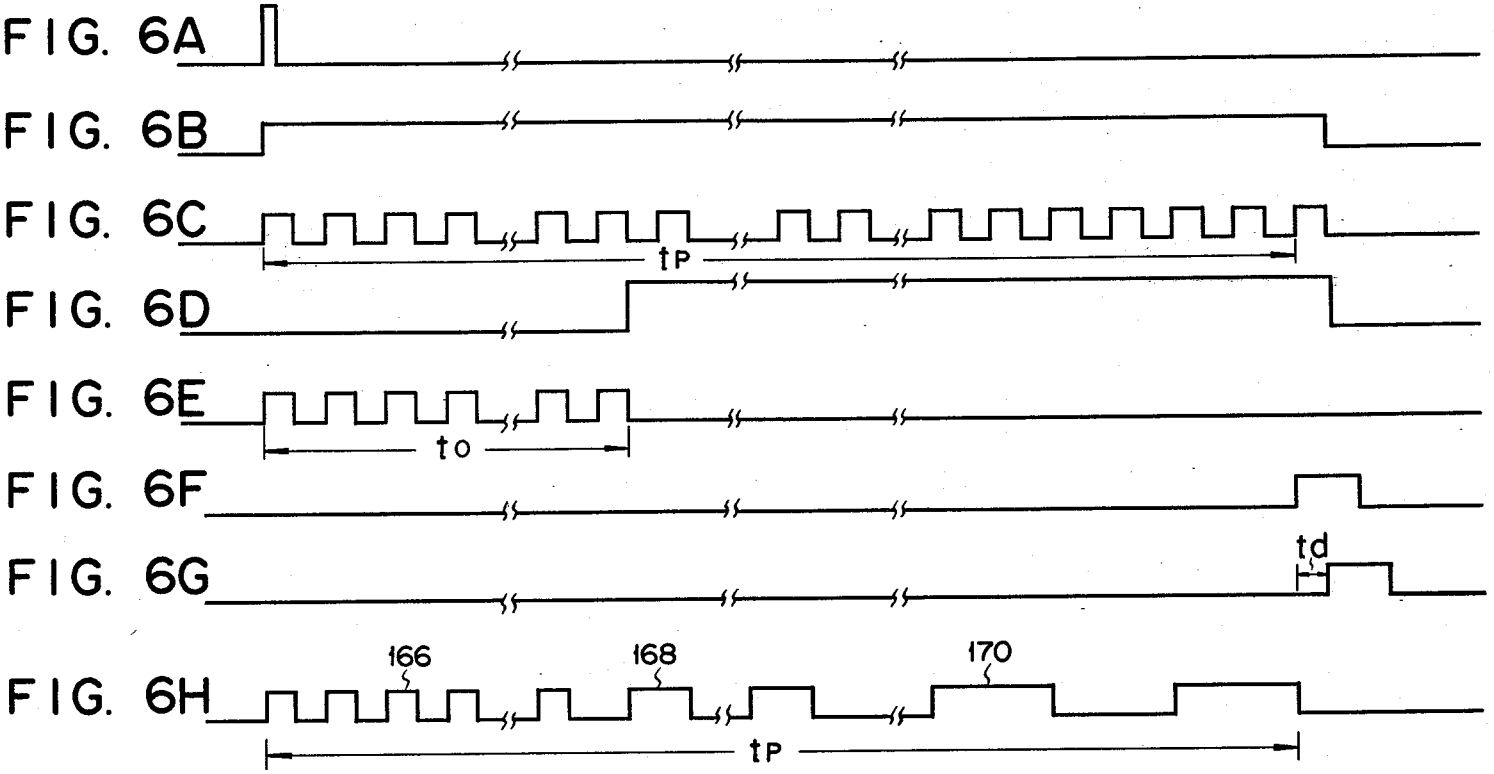
FIG. 6A is a waveform a synchronous signal.
FIG. 6B is a waveform illustrating a Q output of a flip-flop 86.
FIG. 6C is a waveform of clock pulses supplied from the output of an AND gate 94.
FIG. 6D is a waveform of a distance signal produced from a comparator.
FIG. 6E is a waveform of clock pulses supplied to a counter 84.
FIG. 6F is a waveform of a flash terminating signal produced from an AND gate 128.
FIG. 6G is a waveform of a signal supplied from the output of an OR gate 136.
FIG. 6H is a waveform of clock pulses supplied to a counter 122.

The digital section 52 with relation to the distance signal generating circuit 82 will be described referring to FIG. 3. In the digital section 52 shown in FIG. 3, a first counter 84 counts time $t_o$ from a time point that a synchronous signal is applied to the input terminal 40 until the illumination L reaches the given value Lo and a distance signal is produced from the distance signal generating circuit 82. The input terminal 40 is connected to the S input of an RS flip-flop 86. When a synchronous input signal as shown in FIG. 6A is applied to the S input of the RS flip-flop 86, a signal at the Q output of the flip-flop 86 changes from 0 state to 1 state, as shown in FIG. 6B, at the positive edge of the synchronous signal in FIG. 6A. Upon the change of the output signal state, an AND gate 90 is enabled which is connected at the inputs to the Q output of the flip-flop 86 and a clock pulse generator 88 for generating clock pulses of 1 MHz. The AND gate 90 enabled produces at the output clock pulses as shown in FIG. 6C. The clock pulses supplied from the clock pulse generator 88 after the synchronous signal is produced is applied to a counter 84, through an AND gate 94 of which the inputs are connected to the output of the AND gate 90 and the $\overline{Q}$ output of an RS flip-flop 92 held in the 1 state. The clock pulses are counted by the counter 84. When a distance signal as shown in FIG. 6D appears at the S input of the flip-flop 92 connected to the output 80 of the comparator 66 shown in FIG. 2, an output signal at the Q output of the flip-flop 92 changes from 0 state to 1 state and a signal at the $\overline{Q}$ output changes from 1 state to 0 state. As a result, the AND gate 94 is disabled, so that the no further clock pulses are supplied to the counter 84, as shown in FIG. 6E and the measured time $t_o$ including the modified distance information is held in the counter 84. As shown, the counter 84 is connected to a read only memory (ROM) 44 through a multiplexer 95. The outputs $Q_0$ to $Q_5$ of the counter 84 are respectively coupled with first input terminals of AND gates 98, 100, 102, 104, 105 and 108 of which the second inputs coupled with a changeover switch 96 are held in the 1 state. The outputs of the AND gates 98, 100, 102, 104, 106 and 108 are respectively connected through OR gates 101, 103, 105, 107, 109 and 111 to the address inputs $A_0$ to $A_5$. Voltage information of the storage capacitor 8 is applied to the address inputs $A_6$ to $A_8$ of the ROM 44. Specifically, the terminal 41 connected to the storage capacitor 8 is connected through voltage dividing resistors 112 and 114 to an A/D converter 116. Accordingly, a voltage stored in the storage capacitor 8 is applied to the A/D converter 116 where it is A/D converted into corresponding digital signals which are in turn applied to the data inputs $D_0$ to $D_3$ of a latch 118. The latch input C of the latch circuit 118 is connected to the $\overline{Q}$ output of the flip-flop 86. As already stated, when the synchronous signal is applied to the S input of the flip-flop 86, the output state of the Q output of the S input changes from 1 state to 0 state. The output signal from the flip-flop 86 is applied as a latch input signal to the latch input C of the latch 118, so that the voltage data from the A/D converter 116 is latched in the latch 118. In this way, the charge voltage at the time of generation of the synchronous signal is held as voltage data in the latch 118. The outputs $Q_0$ to $Q_2$ of the latch 118 are respectively connected to the address inputs $A_6$ to $A_8$ of the ROM 44. The address input $A_9$ of the ROM 44 connected to the switch 96 is held in the 1 state. The upper address of the ROM 44 is determined by the voltage data supplied from the latch 118. For example, when the charge voltage from the storage capacitor 8 is 350 V, a curve of the luminous flux emitted by the flash lamp 10 is determined as the curve I shown in FIG. 4. In the ROM, the lower address of the ROM 44 is determined by the modified distance data supplied from the counter 84. Additionally, the 1 state of the address input $A_9$ determines the first area in the lower address. As recalled, when the storage capacitor 8 and the measured time $t_o$ taken for the illumination to raech the Lo are determined, the distance from the camera to the object is determined and hence the optimum exposure time $t_p$ is determined. Therefore, the optimum exposure time data in the ROM 44 is specified by the distance data applied to the address input $A_0$ to $A_5$ and $A_9$, and is read out from the ROM 44 and applied to data inputs $A_0$ to $A_7$ of a comparator 120. The outputs $Q_0$ to $Q_7$ of a counter 122 are respectively coupled with the other inputs $B_0$ to $B_7$ of the comparator 120. When the count of the counter 122 reaches the appropriate exposure time $t_p$, the comparator 120 produces an output signal of 1 state, as shown in FIG. 6F. The 1 state signal is applied through an OR gate 124 to the S input of an RS flip-flop 126, so that the Q output of the flip-flop 126 changes from 0 state to 1 state. The Q output of the flip-flop 126 is connected to one input of an AND gate 128 of which the other input is connected to the Q output of a flip-flop 126 which changes its Q output state from 0 state to 1 state when it receives at the S input the distance signal. Before the flip-flop 126 provides a 1 state signal to the one input of the AND gate 128, the 1 state signal is applied from the flip-flop 92 to the other input of the AND gate 128. Accordingly, when the 1 state signal is applied to the AND gate 128, a 1 state signal appears at the output of the AND gate 128. The 1 state signal supplied from the AND gate 128 is outputted as a flash terminating signal through the terminal 39 to the gate of the commutation SCR 30. As a result, the commutation circuit 26 operates to terminate the flashing of the electric flash lamp 10.

The output from the AND gate 128 is connected to the output terminal 39 and to a delay circuit 134 comprised of a resistor 130 and a capacitor 132. When the AND gate 128 produces the flash terminating signal, the output signal from the OR gate 136 changes from 0 state to 1 state after a given time $t_d$, as shown in FIG. 6G, so that the flip-flops 86, 92 and 126 are reset and the counters 84 and 122 are cleared. Accordingly, the Q output of the flip-flop 86 is in the 0 state to stop the supply of the clock pulses from the AND gate 90, as shown in FIG. 6C. Further, the Q outputs of the flip-flops 92 and 126 are in the 0 state to disable the AND gate 128 to stop the supply of the flash terminating signal. At this time, the $\overline{Q}$ outputs of the flip-flops 86 and 92 are again in the 1 state, the latch 118 is reset, and the one input of the AND gate 94 is held in the 1 state. In this way, the circuit is ready for the next flashing control of the flash lamp 10. A differential circuit 142 including a resistor 138 and a capacitor 140 is connected to the input of the OR gate 136. The differential circuit 142 detects a power switch closed signal produced when the power switch 4 is closed, and applies it to the AND gate 136. At the time of close of the power switch 4, the flip-flops 86, 92 and 126 accordingly are reset as in the case of the generation of the flash lamp terminating signal, and thus the counters 84 and 122 are cleared.

When the distance from the flash lamp 10 to the object is large and/or when the F number and the film sensitivity are improper, the synchronous signal is produced, so that, when the flash lamp 10 is driven to flash, the lamp 10 is deenergized by the flash terminating signal produced after a short time. Specifically, when a long time is taken till the distance signal is produced from the comparator 66, the counter 84 overflows before the distance signal is produced. At this time, the inputs of the AND gate 144 connected to the outputs of the counter 84 are all in the 1 state. As a result, a signal of "1" state is applied from the output of the AND gate 144 through the OR gate 124 to the S input of the flip-flop 126 to set the flip-flop 126 and the one input of the AND gate 128 is held in the 1 state. When the distance signal is supplied to the flip-flop 92, the other input of the AND gate 128 is in the 1 state, so that the AND gate 128 produces the flash terminating signal to terminate the flashing of the flash lamp 10.

Figure 3:
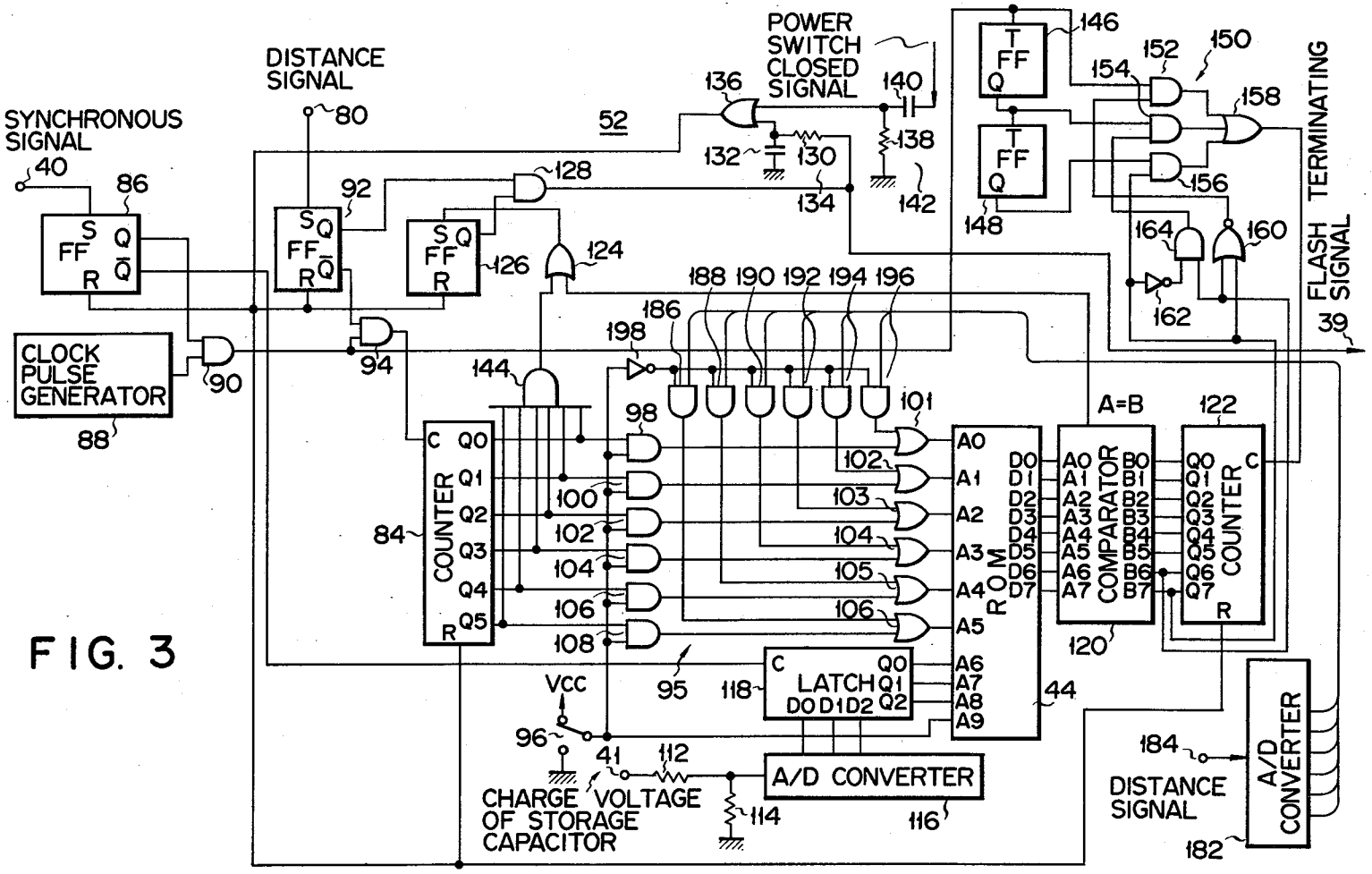
FIG. 3 is a circuit diagram of a digital section of the flash terminating signal generating circuit used in the circuit of FIG. 1.

The embodiment shown in FIG. 3 uses frequency dividers 146 and 148 comprised of T flip-flops, and a multiplexer 150 between the AND gate 90 and the counter 122, for the purpose of simplifying the digital section 52 by decreasing the number of the bits for the ROM 44 and the counter 122. The output of the AND gate 90 is connected to the first input of an AND gate 152 and to the T input of a T flip-flop 146. The Q output of the T flip-flop 146 is connected to the first input of the AND gate 154 and to the T input of another T flip-flop 148. The Q output of the T flip-flop 148 is connected to the first input of an AND gate 156. The outputs of those AND gates 152, 154 and 156 are connected through an OR gate 158 to the input C of the counter 122. The most significant output $Q_7$ of the counter 122 is connected to the first input of a NOR gate 160 and the second input of the AND gate 156, and to the first input of the AND gate 164 through an inverter 162. The output $Q_6$ of the counter 122 which is one place lower than the most significant output is connected to the second inputs of the NOR gate 160 and the AND gate 164. The output of the NOR gate 160 is connected to the second input of the AND gate 152. The output of the AND gate 164 is connected to the second input of the AND gate 154. Accordingly, at the initial stage of counting, the clock pulses shown in FIG. 6C, the outputs $Q_6$ and $Q_7$ of the counter 122 are in the 0 state, so that the NOR gate 160 produces signal of 1 state. As a result, the clock pulses an indicated by numeral 166 in FIG. 6H, are supplied through the AND gate 152 and the OR gate 158 to the counter 122. The counter 122 counts those pulses. When the counter 122 counts the given number of the clock pulses, the output state of the output $Q_6$ of the counter 122 becomes 1 and the output state of the NOR gate 160 becomes 0 to disable the AND gate 152. At this time, the output state of the AND gate 164 becomes 1. For this, the AND gate 154 is enabled, so that the T flip-flop 146 of which the Q output state changes every positive edge of the clock pulse supplied to the T input thereof, produces clock pulses with $\frac{1}{2}$ frequency of the FIG. 6C clock pulses, as shown in FIG. 6H, and applies them to the counter 122 through the AND gate 154 and the OR gate 158. When the state of the output $Q_7$ of the counter 122 becomes 1, the AND gate 154 is disabled and the AND gate 156 is enabled to allow the clock pulses with $\frac{1}{4}$ frequency denoted as 170 in FIG. 6C to be supplied to the counter 122.

Thus, the counter 122 counts coarsely the time t at the latter stage of the discharge of the flash lamp 10. This is due to the characteristic of the flash lamp 10. More specifically, as seen from the time-variation of the luminous flux curves I, II and III in FIG. 4, the luminous flux curves steeply increase at the initial stage of the discharge of the flash lamp 10, but gently decreases after about 250 $\mu$s seconds, or the peaks of the curves. Therefore, it is necessary to count the time t correctly and precisely at the initial stage of the discharge of the flash lamp, but a coarse count of time t is allowed at the latter stage.

The above description refers to the case where the distance information r is detected by the photo diode 54. The explanation to follow is the case where the distance information r is inputted into the circuit from exterior. The variable resistor 172 in FIG. 2 is adjusted by means of a distance measuring means of a camera or a manual dial, for example. A sliding terminal of the variable resistor 172 is connected through the resistor 177 to the inverting input of a logarithmic amplifier 178 including a diode 174 and an operation amplifier 176, through a resistor 177. The non-inverting input of the logarithmic amplifier 178 is grounded, and the output terminal of the amplifier 178 is connected to the input 184 of an A/D converter 182 (FIG. 3), through a resistor 180. The input 184 of the A/D converter 182 is connected to the resistor arrangement 76 through a resistor 186, and the variable resistor 172 is inserted between the reference source 78 and ground. With this connection, the distance signal from the variable resistor 172 when it is set to the distance r, is logarithmic-compressed by the logarithmic amplifier 178 and is modified by a modified signal from the resistor arrangement 76 which logarithmic-compresses the F number and the film sensitivity S, and finally is applied to the A/D converter 182. The A/D converter 182 is connected to the first inputs of the AND gates 186, 188, 190, 192, 194 and 196 of which the second inputs are connected through an inverter 198 to the changeover switch 96. In the case of externally designating the distance r through the variable resistor 172, the changeover switch 96 is coupled with ground or a low level voltage. Therefore, the AND gates 186 to 196 are enabled, so that the modified distance data A/D converted by the A/D converter 182 are applied to ROM 44 through those AND gates 186 to 196 and the OR gates 101 to 106. At this time, the address input $A_9$ of the ROM 44 is in the 0 state, so that the distance data applied to the address inputs $A_0$ to $A_5$ of the ROM 44 specify the second area of the lower address of the ROM 44. When the synchronous switch 22 (FIG. 1) is closed, the counter 122 starts to count the clock pulses, as already mentioned, while at the same time the data of the charge voltage across the storage capacitor held in the latch 118 is supplied to the ROM 44 to specify the lower address. Then, the ROM 44 applies the data of the optimum exposure time $t_p$ to the comparator 120, through the output $D_0$ to $D_8$. The comparator 120 compares the data of the time $t_p$ from the outputs $Q_6$ to $Q_7$ from the counter 122 with the optimum time data from the ROM 44. When both the data are coincided with each other, the comparator 120 produces a signal of 1 state. In response to the 1 state signal, the AND gate 128 produces a flash terminating signal to deenergize the flash lamp 10.

For externally inputting the distance data, the changeover switch 96 is switched and the AND gates 98, 100, 102, 104, 106 and 108 are disabled. Under this condition, even the distance signal generating circuit 82 in FIG. 2 produces the distance signal, no supply of the distance signal from the counter 84 to the ROM 44 is made. A proper signal input to the address input $A_9$ of the ROM 44 specified the first or second area of the lower address. With this function, the ROM 44 discriminates the externally applied distance data from the distance data measured by the flash terminating circuit per se. Accordingly, the ROM 44 may provide the optimum exposure time $t_p$ in accordance with the data received.

The present embodiment is provided with the distance display section 50 for displaying an allowable range of photographing. The display section 50 can display the maximum photographing distance on the basis of the film sensitivity S, the F number and the charge voltage V across the storage capacitor 8. This will be discussed in detail referring again to FIG. 2. The terminal 41, which is connected to the storage capacitor 8, is connected to the inverting input of a logarithmic amplifier 204 having an operational amplifier 200 and a diode 202, via a resistor 206. The non-inverting input of the logarithmic amplifier 240 is earthed. The logarithmic amplifier 204 is further connected at the output to the resistor arrangement 76 through resistors 208 and 211. The cathode of the diode 210 is connected to anode between the resistors 208 and 211. The cathode of the diode 210 is connected to the inverting input of an antilogarithmic amplifier 216 including a resistor 212 and an operational amplifier 214. The non-inverting input of the amplifier 216 is earthed of which the output is connected to the input of an A/D converter 218. In this way, the charge voltage across the storage capacitor 8 is logarithmic-compressed by the logarithmic amplifier 204, is modified by the film sensitivity S and the F number, which are logarithmic-compressed, is converted into a corresponding anti-logarithmic by the anti-logarithmic amplifier 216 and is supplied to the A/D converter 218. The luminous curve as shown in FIG. 4 is determined by the charge voltage V. The allowable photographing distance may be obtained by a total amount of the luminous flux resulting from the integration of the luminous curve with respect to exposure time. Therefore, if a relationship between the charge voltage and the photographing distance is clearly set up, a display decoder/driver 220 drives a display 222 to display the maximum photographing distance $r_{max}$ on the basis of the charge voltage data A/D converted by the A/D converter 218. The output of the anti-logarithmic amplifier 216 and the sliding terminal of the variable resistor 172 are connected to the input of the comparator 224. Through the comparison of the charge voltage signal with the distance signal set by the variable resistor 172, it is possible to judge whether the distance set by the variable resistor is within the allowable range of photographing. In case where the distance r set by the variable resistor 172, the film sensitivity S and the F number, and the charge voltage V across the storage capacitor 8 fail to obtain an optimum exposure, the comparator 224 produces a triggering disable signal. The triggering disabling signal is applied to the transistor 43 shown in FIG. 1, through the terminal 42. As a result, the secondary winding is shorted and therefore the flash lamp 10 is not energized even if the synchronous switch 22 is closed. The triggering disable signal produced from the comparator 224 is supplied to an alarm circuit (not shown). In this case, the alarm circuit may drive a buzzer or intermittently drive a light emission diode for telling impossible photographing. Alternatively, the triggering signal may be used to render the shutter of the camera inactive.

Figure 7:
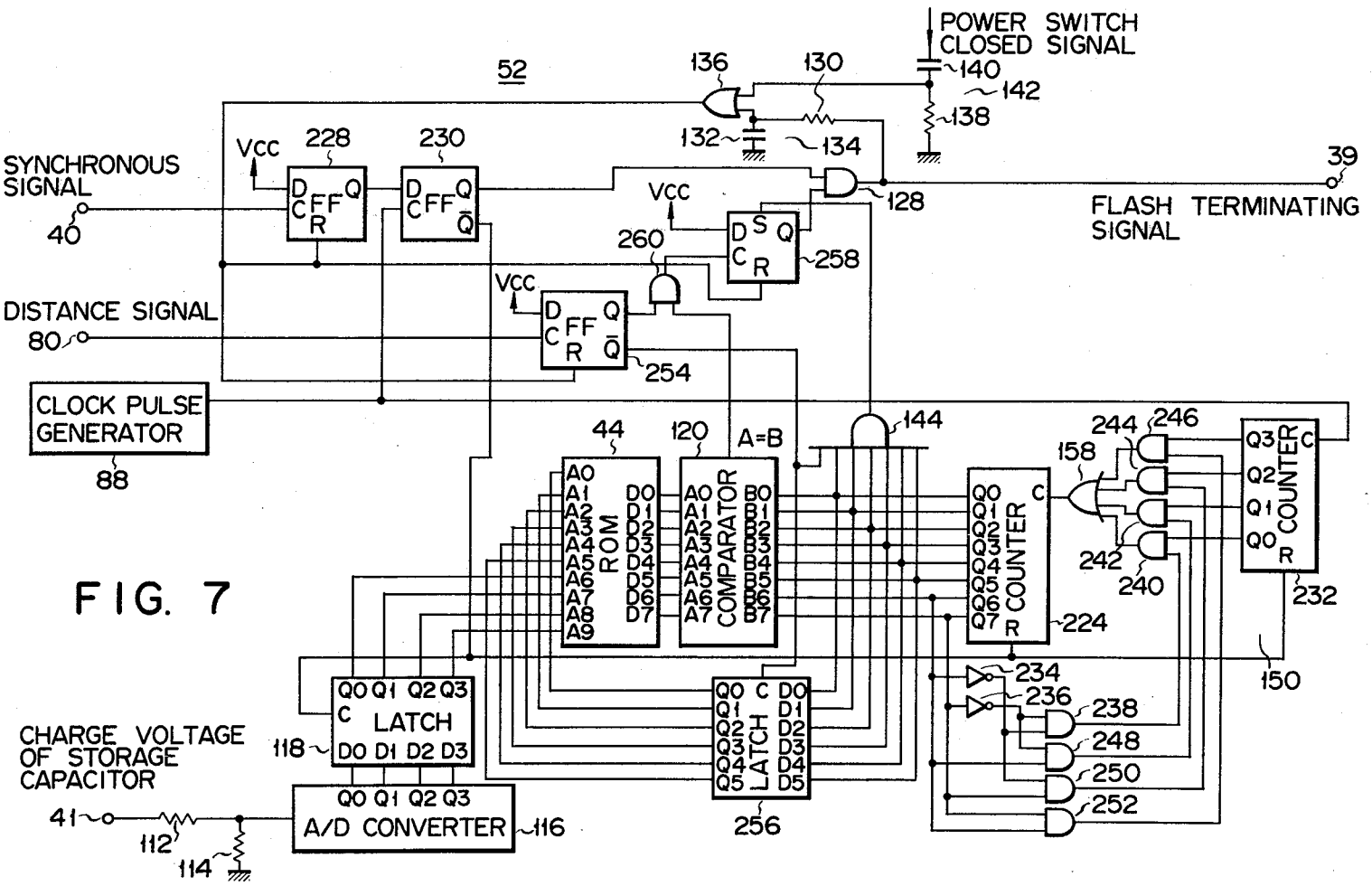
FIG. 7 is a circuit diagram of another embodiment of the digital section of the flash terminating signal generating circuit.

Turning now to FIG. 7, there is shown another embodiment of the digital section of FIG. 3 according to the present invention. Like numerals are used for designating like portions in FIG. 3, for simplicity. A major feature of the present embodiment resides in that a single counter 224 is used in place of the counters 84 and 122 in the embodiment shown in FIG. 3. The embodiment shown in FIG. 7 does not include a section to process the distance signal externally applied, for example, the A/D converter 182 and the multiplexer 95. When a synchronous signal is applied to a D flip-flop 228 of which the D input is held in the 1 state, a D flip-flop 230 has 1 state at the D input. At the positive edge of the clock pulse supplied to the C input of the D flip-flop 230, the Q output of the D flip-flop 230 is in the 1 state, while the Q output is in the 0 state. Further, the charge voltage V is held in the latch 118, counters 224 and 232 are cleared, and the counting of clock pulses starts. The counter 232 serves as a frequency divider. The clock pulses supplied to the C input of the counter 232, at the initial stage, is frequency-divided to have $\frac{1}{2}$ frequency and is applied from the output $Q_0$ of the counter 232 to the counter 224, through an AND gate 240 which is enabled by inverters 234 and 236 and an AND gate 238, and an OR gate 158. When the output $Q_6$ of the counter 224 is in the 1 state, the AND gate 240 is disabled. When an AND gate 248 is in the 1 state, an AND gate 242 is open. As a result, frequency-divided clock pulses with $\frac{1}{4}$ frequency is supplied from the output $Q_1$ of the counter 232 to the counter 224. When the output $Q_6$ of the counter 224 is in the 0 state and the output $Q_7$ is in the 1 state, the output of the AND gate 250 is in the 1 state, so that the counter 232 produces at the output $Q_2$ the frequency-divided clock pulses with $\frac{1}{8}$ frequency which in turn is applied through an AND gate 244 and an OR gate 158 to the counter 224. Similarly, when the outputs $Q_6$ and $Q_7$ of the counter 224 are in the 1 state, an output state of an AND gate 252 is in 1 state and the frequency-divided clock signal with 1/16 frequency are supplied from the output $Q_3$ of the counter 232 to the counter 224, through an AND gate 246. As described above, the counter 244 counts time t after generation of the synchronous signal finely at the initial state and coarsely at the latter stage, as described already.

When the distance signal is produced from the comparator 66, the Q output of the D flip-flop 254 of which the D input is kept 1 state is in the 1 state, while the Q output is in the 0 state. Accordingly, the count data when the distance signal is produced is held in a latch 256. At this time, if the counter overflows, the inputs of an AND gate 144 are all in the 1 state, the D flip-flop 258 is set, and an AND gate 128 produces a flash terminating signal.

The upper and lower addresses in the ROM 44 are determined by the data of the measured time $t_o$ supplied from the latch 256 and the voltage data supplied from the latch 118, so that the data of the optimum exposure time $t_p$ is supplied from the ROM 44 to the comparator 120. The comparator 120 produces a signal of 1 state when the contents of the counter 224 reaches the optimum exposure time $t_p$. Accordingly, the 1 state signal is applied to the C input of the D flip-flop 258, through the AND gate 260. Then, the AND gate 128 produces a flash terminating signal.

The embodiment shown in FIG. 7 has an effect to simplify the construction of the digital section 52.

As described above, in the electric flash lamp unit, the data of the optimum exposure time $t_p$ is stored in the ROM 44. For addressing the $t_p$ data, the charge voltage V across the storage capacitor 8, the distance r from the flash lamp 10 to the object, the F number and the film sensitivity S are used for the address codes. Therefore, the electric flash lamp 10 may properly be controlled so as to always provide an optimum exposure at the time of photographing.

When the electric flash lamp 10 is deenergized, the luminous flux produced from the flash lamp 10 temporarily increases by the reverse biasing voltage applied from the commutation circuit 26. For avoiding the adverse effect by the luminous flux, it is preferable to store the data of the optimum exposure time by previously taking account of the flux increase. When reading the optimum exposure from the ROM 44, the charge voltage V across the storage capacitor is not necessarily used as the address code. In this case, the storage capacitor must always be charged at a fixed voltage. Therefore, it is necessary to additionally use a circuit for charging the storage capacitor at a fixed voltage.

What we claim is:

1. A flash terminating signal generating circuit comprising:

means for generating clock pulses;

means for counting the clock pulses in response to a flash starting signal;

memory means for storing a plurality of time data corresponding to a flash time of an electric flash lamp in a plurality of memory locations with corresponding addresses;

means for converting distance information into a first address data, supplying the first address data to said memory means, thus designating one of the addresses of said memory means, and reading a respective time data from the memory location thus designated; and comparing means for comparing the time data read from said memory means with the contents of said counting means and producing a flash terminating signal when both the time data read from said memory means and the contents of said counting means are coincident with each other.

2. A flash terminating signal generating circuit according to claim 1, further comprising means for modifying the distance information by an F number and a film sensitivity.

3. A flash terminating signal generating circuit according to claim 1, wherein said converting means includes means for converting information of the energy applied to the electric flash lamp into second address data when the electric flash lamp is energized, wherein given time data is read out from the said memory means by said first and second address data.

4. A flash terminating signal generating circuit according to claim 1, wherein said counting means includes a counter for counting clock pulses and a frequency divider which frequency-divides the clock pulses to said counter after said counter counts the given number of clock pulses, and supplies the frequency-divided clock pulses to said counter.

5. A flash terminating signal generating circuit according to claim 1, further comprising means for clearing the contents of said counter after said comparing means produces a flash terminating signal.

6. A flash terminating signal generating circuit according to claim 5, wherein said clear signal producing means further produces a clear signal in response to a power source switch closed signal.

7. A flash terminating signal generating circuit according to claim 1, further comprises means for producing a distance signal representing a distance from a flashing point to an object illuminated with flash light from the flashing point.

8. A flash terminating signal generating circuit according to claim 7, wherein said distance signal generating means includes a variable resistor to provide a resistance corresponding to the distance, and a logarithmic amplifier for converting a signal supplied through said variable resistor into a logarithmic value.

9. A flash terminating signal generating circuit according to claim 8, wherein said distance signal generating means modifies an output signal from said logarithmic amplifier by an F number and a film sensitivity.

10. A flash terminating signal generating circuit comprising:

means for generating clock pulses;

means for counting the clock pulses in response to a flash starting signal;

memory means for storing a plurality of time data corresponding to a flash time of an electric flash lamp in a plurality of memory locations with corresponding addresses;

means for measuring information of a distance from a flashing point to an object illuminated by flash light;

means for converting the distance information supplied from said measuring into first address data, supplying the first address data to said memory means, thus designating one of the addresses of said memory means, and reading a respective time data from the memory location thus designated; and means for comparing the time data read from said memory means with the contents of said counting means and producing a flash terminating signal when both the time data read from the memory means and the contents of said counting means are coincident with each other.

11. A flash terminating signal generating circuit according to claim 10, wherein said distance measuring means produces a distance signal containing the distance information when the illumination of the object reaches a predetermined value, and said converting means holds clock pulses supplied till the distance signal is generated after the flash starting signal is generated, and supplies the counted value as the first address data to said memory means.

12. A flash terminating signal generating circuit according to claim 11, wherein said distance measuring means includes a photoelectric converter which detects the illumination of the object to convert it into an electrical signal, and means for comparing the electric signal from said photoelectric converter with a reference signal and producing a distance signal when those are coincident with each other.

13. A flash terminating signal generating circuit according to claim 11, wherein said converting means includes counting means which starts the counting of clock pulses in response to the flash starting signal and stops the counting of the clock pulses in response to the distance signal from said distance measuring means.

14. A flash terminating signal generating circuit according to claim 12, wherein said comparing means further includes means for modifying the reference signal supplied to said comparing means by a film sensitivity and an F number.

15. A flash terminating signal generating circuit according to claim 12, wherein said photoelectric converter includes a photo detector for converting a light into an electric signal and a logarithmic amplifier for converting the output electric signal from said photo detector into a logarithmic value; and said comparing means includes a comparator for comparing the output signal from said logarithmic amplifier with the reference signal and means for producing a reference signal modified by the logarithmic values of the film sensitivity and the F number.

16. A flash terminating signal generating circuit according to claim 11, wherein said converting means includes means for holding the number of clock pulses counted by said counting means till the distance signal is generated.

17. A flash terminating signal generating circuit according to claim 10, wherein said converting means includes means for converting information of the energy applied to the electric flash lamp into second address data when the electric flash lamp is energized, wherein given time data is read out from said memory means by said first and second address data.

18. A flash terminating signal generating circuit according to claim 10, wherein said counting means includes a counter for counting clock pulses and a frequency divider which frequency-divides the clock pulses to said counter after said counter counts the given number of clock pulses, and supplies the frequench-divided clock pulses to said counter.

19. A flash terminating signal generating circuit according to claim 10, further comprising means for clearing the contents of said counter after said comparing means produces a flash terminating signal.

20. A flash terminating signal generating circuit according to claim 19, wherein said clear signal producing means further produces a clear signal in response to a power source switch closed signal.

21. A flash terminating signal generating circuit according to claim 13, further comprising means for producing a signal to clear the contents of said counter means after said comparing means produces a flash terminating signal.

22. A flash terminating signal generating circuit according to claim 21, wherein said clear signal generating means produces a clear signal in response to a power source switch closed signal.

23. A flash terminating signal generating circuit according to claim 10, further comprising means for converting distance information supplied from exterior into third address data, and wherein said converting means supplies either of said first address data or said third address data to said memory means to read out the given time data with the address data supplied.

24. A flash terminating signal generating circuit according to claim 23, further comprising a multiplexer for supplying one of said first and third address data to said memory means and signal generating means for designating the data to be supplied to said multiplexer and said memory means.

25. An electric flash lamp unit for energizing an electric flash lamp by supplying the lamp with energy stored in a capacitor, comprising:

means for detecting a voltage charged in said capacitor to produce a charge voltage signal;

means for modifying the charge voltage signal supplied from said detecting means with a film sensitivity and an F number; and means for comparing the modified charge voltage signal with a reference signal containing distance information and producing an alarm signal.

26. An electric flash lamp unit according to claim 25, wherein said charge voltage detecting means includes a logarithmic amplifier for converting a charge voltage into a logarithmic value and said modifying means modifies an output signal from said logarithmic amplifier by the logarithmic values of the film sensitivity and the F number.

27. An electric flash lamp unit for energizing an electric flash lamp by supplying the lamp with energy stored in a capacitor, comprising:

means for detecting a voltage charged in said capacitor to generate a charge voltage signal;

means for modifying the charge voltage signal supplied from said detecting means by a film sensitivity and an F number; and means for decoding the modified charge voltage signal from said modifying means into distance information and displaying the decoded distance information as a maximum photographing distance.

* * * * *